US005799927A

United States Patent [19]

Geist

[11] Patent Number: 5,799,927

[45] Date of Patent: Sep. 1, 1998

[54] RADIAL ROTARY SLIDE VALVE FOR CONTROLLING THE STEAM FLOW RATE IN A STEAM TURBINE

[75] Inventor: Richard Geist, Lauf, Germany

[73] Assignee: ABB Patent GmbH, Mannheim, Germany

[21] Appl. No.: 863,360

[22] Filed: May 27, 1997

[30] Foreign Application Priority Data

May 24, 1996 [DE] Germany ..... 196 20 949.8

[51] Int. Cl.[6] ..... F01D 1/30

[52] U.S. Cl. ..... 251/212; 251/304; 415/159; 415/148

[58] Field of Search ..... 215/212, 304; 415/159, 148

[56] References Cited

U.S. PATENT DOCUMENTS

| | | | |
|---|---|---|---|
| 2,666,618 | 1/1954 | Jaquith | 251/304 X |
| 3,860,357 | 1/1975 | Grainger | 415/159 X |
| 5,370,578 | 12/1994 | Yi | 251/212 X |
| 5,409,351 | 4/1995 | Geist | 415/159 |

*Primary Examiner*—Kevin Lee

*Attorney, Agent, or Firm*—Herbert L. Lerner; Laurence A. Greenberg

[57] ABSTRACT

A radial rotary slide valve for controlling a steam flow rate in a steam turbine, includes an immobile fixed ring and a rotary ring which is disposed concentrically on the latter in such a way as to be rotatable into an angular position that can be varied through the use of a servo motor. The rotary ring has first control profiles which correspond to corresponding second control profiles belonging to the fixed ring in such a way that control slots situated between the control profiles can be varied for opening or closing. The rotary ring is divided into a top part and a bottom part by a joint in the region of a joint in the casing. In order to optimize the play required for sliding between the fixed ring and the rotary ring, the top part of the rotary ring and the bottom part of the rotary ring can be connected to one another by a suitable connecting device for varying the distance between at least two opposing half-ring ends. This makes it possible to vary an inside diameter of the rotary ring to accommodate the sliding play required for rotary movements between the rotary ring and the fixed ring.

8 Claims, 2 Drawing Sheets

1
2
2a
2b
3
4
6
8
9
10
16
X

RADIAL ROTARY SLIDE VALVE FOR CONTROLLING THE STEAM FLOW RATE IN A STEAM TURBINE

BACKGROUND OF THE INVENTION

Field of the Invention

The invention relates to a radial rotary slide valve for controlling a steam flow rate in a steam turbine, including an immobile fixed ring and a rotary ring disposed concentrically on the latter in such a way as to be rotatable into an angular position that can be varied by a servo motor, the rotary ring having control profiles corresponding with corresponding control profiles of the fixed ring to vary control slots between the control profiles for opening and closing, and the rotary ring being divided in the region of a joint into a top part and a bottom part.

In steam turbine construction, almost exclusive use is made of valves which are not of the rotary-slide type to control steam bleeds, although in comparison rotary slide valves are of relatively simple construction and also have a number of other advantages. Problems are posed, however, by the sliding conditions under which the rotary ring has to be capable of rotary displacement on the fixed ring. Of great significance in that case are pressure conditions generated by static pressure forces since they are responsible for friction between the components which slide on one another. While there is no relief from those problems in the case of axial rotary slide valves, there is automatic static relief of the rotary ring, situated on the outside, in the case of radial rotary slide valves, due to the fact that the static steam forces counteract one another.

German Published, Non-Prosecuted Patent Application DE 42 14 775 A1, corresponding to U.S. application Ser. No. 08/180,106, filed Jan. 12, 1994, has disclosed an axial rotary slide valve in which the sliding friction of the rotary ring is largely replaced by rolling friction with the aid of axial needle bearing rings. A corresponding rolling bearing configuration is, of course, also possible in the case of radial rotary slide valves but is only acceptable if the sliding gap which arises in that case is so small that the steam losses due to it remain small. However, a very narrow sliding gap is difficult to control, not only because manufacturing tolerances are small, but because of the fact that it can lead to problems even under normal operating conditions. During use, rotary slide valves are subject to the action of temperatures of several hundred degrees. Nonuniform thermal expansion in the rotary ring, on one hand, and the fixed ring, on the other hand, can give rise to large movement-inhibiting forces because the play provided disappears and, as a result, actual jamming is produced.

SUMMARY OF THE INVENTION

It is accordingly an object of the invention to provide a radial rotary slide valve for controlling the steam flow rate in a steam turbine, which overcomes the hereinaforementioned disadvantages of the heretofore-known devices of this general type, in which a width of a sliding gap is successfully optimized and a risk of jamming of the system, which is extremely risky for turbine operation, is avoided or at least significantly reduced.

With the foregoing and other objects in view there is provided, in accordance with the invention, a radial rotary slide valve for controlling a steam flow rate in a steam turbine, comprising an immobile fixed ring; a rotary ring disposed concentrically and rotatably on the fixed ring, the rotary ring divided along a joint into a top half-ring part and a bottom half-ring part having opposing half-ring ends; a servo motor for varying an angular position of the rotary ring; the rotary ring having first control profiles and the fixed ring having second control profiles, the first and second control profiles defining control slots therebetween and the first and second control profiles corresponding with each other for variably opening and closing the control slots; and a connecting device interconnecting the top and bottom half-ring parts of the rotary ring for varying a distance between at least two of the opposing half-ring ends and permitting a change in inside diameter of the rotary ring to accommodate a sliding play required for rotary movements between the rotary ring and the fixed ring.

Just as the turbine casing is split into a top part and a bottom part by a joint, the fixed ring and the rotary ring are fundamentally split in the case of a radial rotary slide valve. However, in contrast to conventional structures, it is a significant advantage of the structure according to the invention that the top part of the rotary ring and the bottom part of the rotary ring are not connected rigidly but instead are connected to one another by a suitable connecting device in such a way that the distance between at least two opposing ends of these two ring halves can be varied. This makes it possible to vary the inside diameter of the rotary ring, and the sliding play required for rotary movements between the rotary ring and the fixed ring can be accommodated.

In accordance with another feature of the invention, the connecting device interacts with at least one spring element which normally holds the two parts of the rotary ring firmly together but, under the action of clamping forces, automatically makes an enlargement of the sliding play possible.

In accordance with a further feature of the invention, the use of one spring element on each of the two ends of the ring halves to be connected to one another can be further simplified by holding two opposing ends of the two halves of the rotary ring together through the use of a hinge, so that just one spring element is required.

In accordance with an added feature of the invention, in order to provide for the use of the spring element on the two opposing ends of the two halves of the rotary ring which are not connected by a hinge, a collared bolt is provided for engagement at this location. The collared bolt is screwed into a threaded bush belonging to one half of the rotary ring. The head of the collared bolt engages on a compression spring which is supported on a collar on the other half of the rotary ring. As soon as clamping forces occur which are greater than the spring force stemming from the compression spring and connecting the two halves of the ring, the joint between the two halves of the ring increases in size at this point and the sliding friction is reduced.

Even more reliable opening of the joints in the event of excessive sliding friction is achieved if the actuating forces of the servo motor which actuates the rotary ring engage directly on the joint. Therefore, in accordance with an additional feature of the invention, there is provided a coupling lever which establishes the connection with the servo motor and ends at a coupling fork having prongs on which respective inward-pointing studs are secured, and centrally with respect to the joint, these two studs engage in a hole, one half of which is formed in the top part of the rotary ring and the other half of which is formed in the bottom part of the rotary ring.

The control profiles determine the nature of the control slots which belong to the steam duct and are opened or closed in accordance with the direction of actuation of the rotary ring. It is advantageous to give the control profiles an aerodynamic shape. In accordance with yet another feature of the invention, the fixed ring is assigned the profile heads, while the profile ends are situated in the fixed ring. When the control slots are fully open, the total profile then comes into effect.

In accordance with a concomitant feature of the invention, although the automatic enlargement of the sliding play is very advantageous, it is also possible, as an alternative, to provide a connecting device which can be adjusted through the use of corresponding tools, preferably by actuating screw-action elements. This would make it possible to optimize the required sliding play in each individual case.

Other features which are considered as characteristic for the invention are set forth in the appended claims.

Although the invention is illustrated and described herein as embodied in a radial rotary slide valve for controlling the steam flow rate in a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
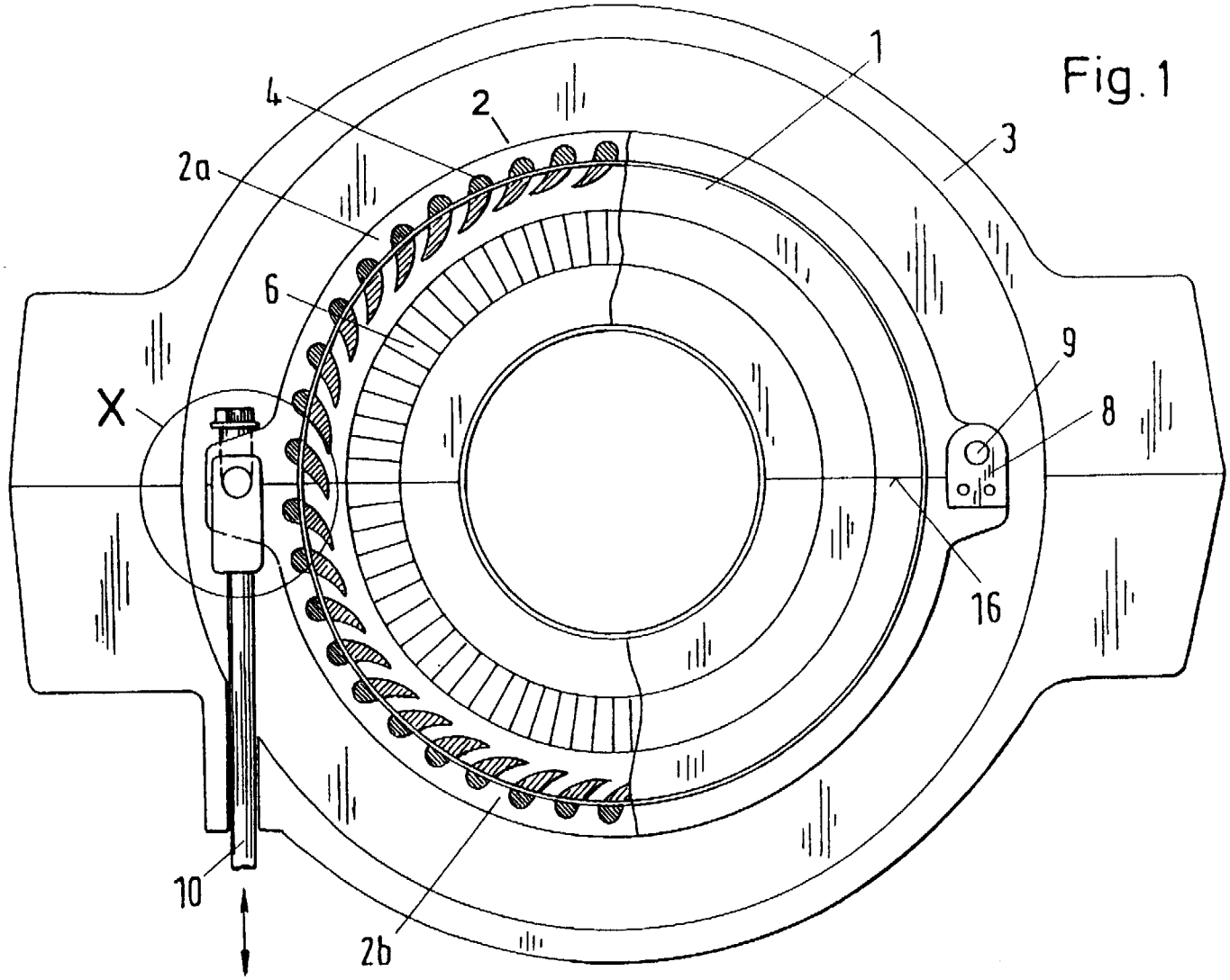
FIG. 1 is a diagrammatic, radial-sectional view of a steamturbine casing in the vicinity of a rotary slide valve, showing top and bottom parts and a connecting device.
Figure 2A:
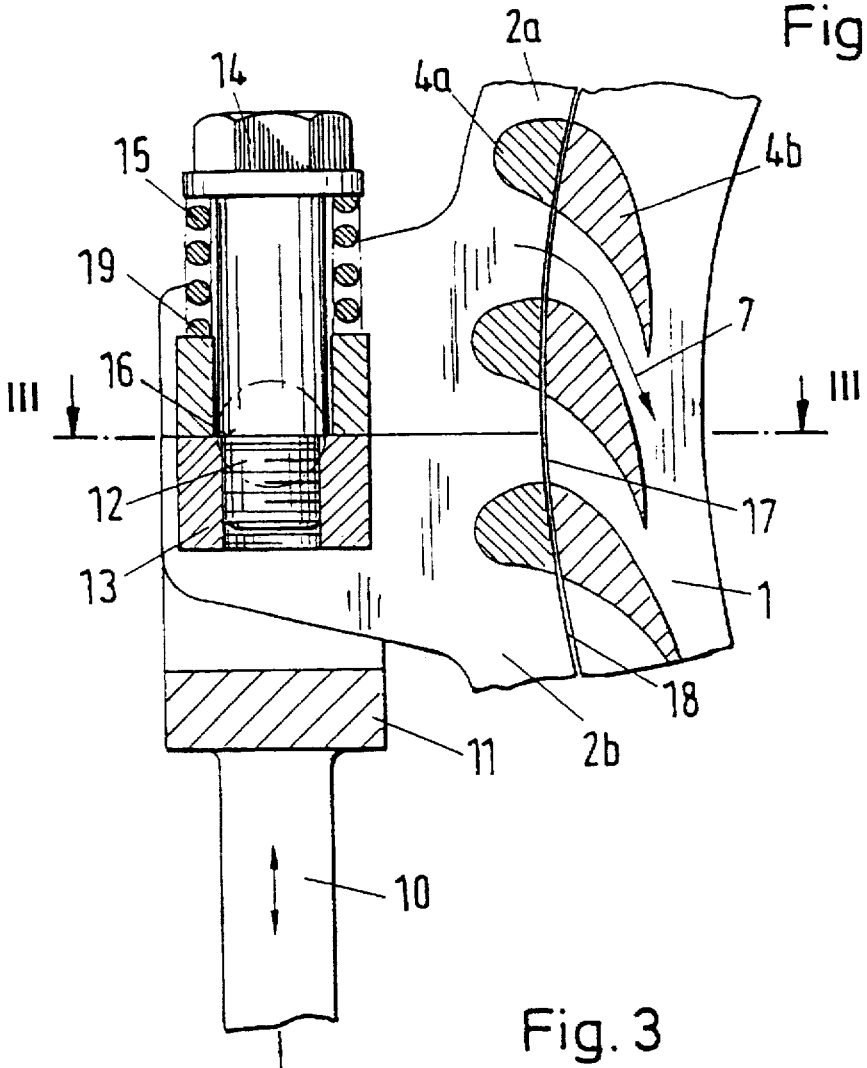
FIG. 2 is an enlarged, fragmentary view of a portion X of the radial rotary slide valve with the connecting device and an actuating device of a servo motor.
Figure 3:
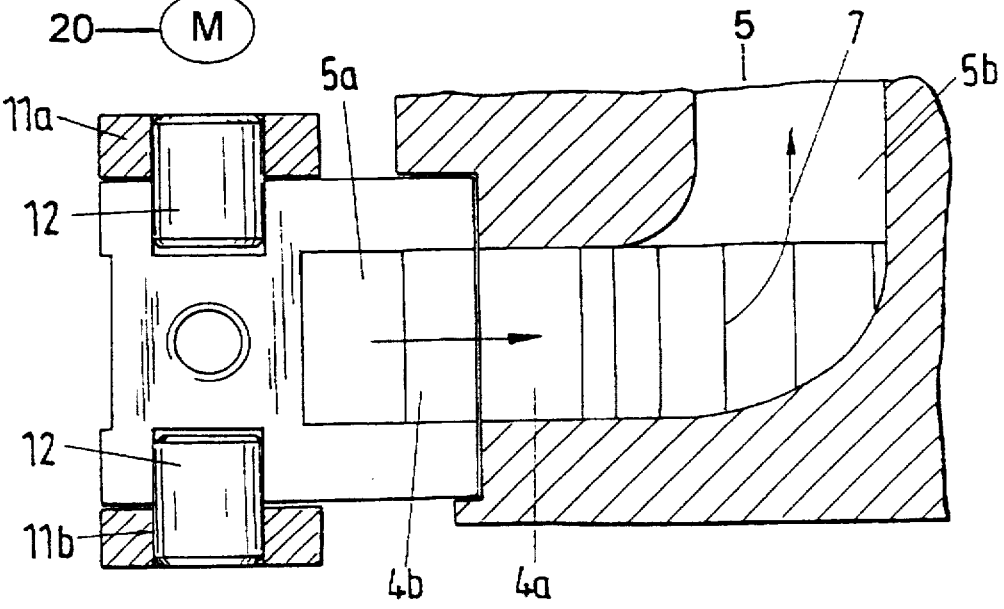
FIG. 3 is a fragmentary, sectional view taken along a line III-II of FIG. 2, in the direction of the arrows, showing the actuating device of FIG. 2 in the vicinity of a joint.

Referring now to the figures of the drawings in detail, it is noted that an understanding of the configuration to be described below will be facilitated if complementary details of FIGS. 1 to 3 are considered together. A radial rotary slide valve 1, 2 which is disposed within a turbine casing 3 has a fixed ring 1 and an outer, rotary ring 2, which is disposed concentrically with respect to the latter. Both the turbine casing 3 and the radial rotary slide valve 1, 2 are divided into top and bottom parts along a joint 16.

Steam is controlled through the use of control profiles 4, having profile heads 4*a* which are assigned to the rotary ring 2 and profile ends 4*b* which are assigned to the fixed ring 1. Control slots 17, which are disposed between the control profiles, belong to a steam duct 5 and are fully open in the illustrations provided. In this angular position of the rotary ring 2 relative to the fixed ring 1, the profile heads 4*a* and the profile ends 4*b* rest form-lockingly on one another and, by virtue of their aerodynamically optimized shape, pose only a relatively low resistance to the steam flowing through from a front part 5*a* of the steam duct to a rear part 5*b* of the steam duct in a steam direction 7. The steam then passes from there to rotor blades of a turbine rotor 6. The profile heads 4*a* can be displaced by turning the rotary ring 2 to such an extent relative to the profile ends 4*b* that the control slots 17 are fully closed. The shape of the control profiles 4 is then no longer as significant with a reduced cross-section of the control slots 17.

A schematically illustrated servo motor 20 engages on the rotary ring 2 by way of a coupling lever 10, to provide for the rotary adjustment of the rotary ring 2 relative to the fixed ring 1. For this purpose, an end of the coupling lever 10 has a coupling fork 11 with fork prongs 11*a*, 11*b* in which inward-pointing studs 12 are secured and engage in corresponding holes in the rotary ring 2 in the vicinity of the joint 16. In the configuration described thus far, a tensile force from the servo motor 20 would pull the bottom part or half-ring 2*b* of the rotary ring away from the top part or half-ring 2*a* of the rotary ring, while the conditions would be reversed in the case of a compressive force. In both cases, however, the inside diameter of the rotary ring 2 and of the sliding gap 18 at the joint 16 would increase.

However, an enlargement of the inside diameter should only take place when the sliding friction exceeds a predetermined limit value in order to reduce this value to an appropriate magnitude in this case. For this purpose, a correspondingly dimensioned compression spring 15 is provided which is held by a head of a collared bolt 14 and pressed against a collar 19 at the top part or half-ring 2*a* of the rotary ring. Since the collared bolt 14 is screwed into a threaded bush 13 on the bottom part or half-ring 2*b* of the rotary ring, the top part 2*a* of the rotary ring and the bottom part 2*b* of the rotary ring are held together by the compression spring 15 with its inherent spring force. The collar 19 and the threaded bush 13 are disposed at opposed half-ring ends of the rotary ring 2. It is only if friction which exceeds this spring force arises between the rotary ring 2 and the fixed ring 1 that the sliding gap 18 in the region of the joint 16 increases in size upon actuation of the coupling lever 10 to such an extent that the sliding friction falls and a rotary movement becomes possible. A hinge 8 with a hinge shaft 9 holds two opposite ends of the two parts or half-rings 2*a*, 2*b* of the rotary ring together. Elements 8, 9 and 11 to 15 together form a connecting device.

I claim:

1. A radial rotary slide valve for controlling a steam flow rate in a steam turbine, comprising:

an immobile fixed ring;

a rotary ring disposed concentrically and rotatably on said fixed ring, said rotary ring divided along a joint into a top half-ring part and a bottom half-ring part having opposing half-ring ends;

a servo motor for varying an angular position of said rotary ring;

said rotary ring having first control profiles and said fixed ring having second control profiles, said first control profiles adjacent to said second control profiles defining control slots therebetween, and said first and second control profiles corresponding with each other for variably opening and closing said control slots; and a connecting device interconnecting said top and bottom half-ring parts of said rotary ring for varying a distance between at least two of said opposing half-ring ends and permitting a change in an inside diameter of said rotary ring to accommodate a sliding play required for rotary movements between said rotary ring and said fixed ring.

2. The radial rotary slide valve according to claim 1, wherein said connecting device includes at least one spring element normally holding said two parts of said rotary ring firmly together but automatically permitting an enlargement of the sliding play under the action of clamping forces.

3. The radial rotary slide valve according to claim 1, wherein said connecting device includes a hinge holding another two of said opposing half-ring ends of said rotary ring together.

4. The radial rotary slide valve according to claim 3, wherein said half-ring ends of said rotary ring include a first two half-ring ends connected by said hinge and a second two half-ring ends, and said connecting device includes a threaded bush at one of said second two half-ring ends, a collar at the other of said second two half-ring ends, a compression spring supported on said collar, and a collared bolt screwed into said threaded bush and having a head engaging said compression spring.

5. The radial rotary slide valve according to claim 1, including a coupling lever establishing a connection with said servo motor and ending at a coupling fork having prongs, and inward-pointing studs each secured on a respective one of said prongs, said studs each engaging centrally relative to said joint in a respective hole having one half formed in said top half-ring part of said rotary ring and another half formed in said bottom half-ring part of said rotary ring.

6. The radial rotary slide valve according to claim 1, wherein said first control profiles are profile heads associated with said rotary ring, said second control profiles are profile ends associated with said fixed ring, said control slots are part of a steam duct, and said heads and ends open and close said control slots by virtue of their position relative to one another.

7. The radial rotary slide valve according to claim 1, wherein said connecting device is adjustable.

8. The radial rotary slide valve according to claim 1, wherein said connecting device is adjustable by actuating screw-action elements.

* * * * *